US006308492B1

(12) United States Patent
Focke et al.

(10) Patent No.: US 6,308,492 B1
(45) Date of Patent: Oct. 30, 2001

(54) PROCESS AND APPARATUS FOR PRODUCING PACKS

(75) Inventors: Heinz Focke, Verden; Henry Buse, Visselhövede; Gisbert Engel, Essel, all of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/335,906

(22) Filed: Jun. 18, 1999

(30) Foreign Application Priority Data

Jun. 19, 1998 (DE) ..... 198 27 412

(51) Int. Cl.[7] ..... B65B 57/00

(52) U.S. Cl. ..... 53/55; 53/65; 53/148; 250/548

(58) Field of Search ..... 53/51, 53, 55, 53/65, 148, 149, 150, 151, 201, 207, 444; 250/548; 382/143

(56) References Cited

U.S. PATENT DOCUMENTS

| | | | | |
|---|---|---|---|---|
| 4,641,771 | * | 2/1987 | Masuch et al. | 53/55 |
| 4,682,038 | * | 7/1987 | Kocke | 250/548 |
| 4,972,494 | * | 11/1990 | White et al. | 382/143 |
| 5,607,121 | * | 3/1997 | Boriani et al. | 242/563.2 |
| 5,877,506 | * | 3/1999 | Focke et al. | 53/53 |
| 5,970,682 | * | 10/1999 | Focke et al. | 53/53 |
| 6,038,836 | * | 3/2000 | Focke et al. | 53/207 |
| 6,158,193 | * | 12/2000 | Focke et al. | 53/53 |

FOREIGN PATENT DOCUMENTS

| | | |
|---|---|---|
| 2137937 | 2/1973 | (DE) . |
| 77 06 956 | 3/1980 | (DE) . |
| 42 16 286 | 12/1993 | (DE) . |
| 195 43 246 | 5/1996 | (DE) . |
| 195 10 392 | 9/1996 | (DE) . |
| 196 07 215 | 8/1997 | (DE) . |
| 196 14 920 | 8/1997 | (DE) . |
| 197 01 618 | 7/1998 | (DE) . |
| 142 129 | 5/1985 | (EP) . |
| 157 087 | 10/1985 | (EP) . |
| 330 495 | 8/1989 | (EP) . |
| 677 444 | 10/1995 | (EP) . |
| 693 424 | 1/1996 | (EP) . |
| 790 187 | 8/1997 | (EP) . |
| 791 539 | 8/1997 | (EP) . |
| 1 323 552 | 7/1973 | (GB) . |

* cited by examiner

*Primary Examiner*—Peter Vo
*Assistant Examiner*—Louis K. Huynh
(74) *Attorney, Agent, or Firm*—Sughrue, Mion, Zinn, Macpeak & Seas, PLLC

(57) ABSTRACT

The invention relates to a process and an apparatus for producing packs, in particular cigarette packs. A change in the type of pack makes it necessary for the operators carefully to provide the correct packaging material assigned to the new type of pack. In practice, this change of material often takes place incorrectly. The invention avoid errors when the type of pack is changed in that markings, which are assigned to packaging material of different designs and are provided on the packaging material and/or the carrier thereof, in particular on a core of the reel, and/or the pack, are used to identify the packaging material and to check it for correct assignment in relation to the type of pack which is to be produced.

5 Claims, 4 Drawing Sheets

11
10
13
10
12
14
15
16
21
20
25
26
24

PROCESS AND APPARATUS FOR PRODUCING PACKS

BACKGROUND OF THE INVENTION

The invention relates to a process for producing packs, in particular cigarette packs, using, for the purpose of wrapping pack contents, packaging material, namely prefabricated blank, material webs wound as a reel and/or blanks severed from said material webs. The invention also relates to an apparatus for carrying out the process.

In packaging technology, in particular during the production of cigarette packs, it is often required to produce different types of pack one after the other on the same packaging machine. The differences here may mean different text, designs or else contents, that is to say different cigarettes in particular. The change in the type of pack makes it necessary for the operators carefully to provide the correct packaging material assigned to the new type of pack.

SUMMARY OF THE INVENTION

The object of the invention is to facilitate and, in particular, render more reliable, the operation of changing a type of pack of a packaging machine, in particular for producing cigarette packs, so as to avoid the use of incorrect packaging material.

In order to achieve this object, the process according to the invention is characterized in that, when a packaging machine is started up or when the type of pack which is to be produced is changed, or when the packaging material (reel) is changed, markings, which are assigned to packaging material of different designs and are provided on the packaging material and/or the carrier thereof, in particular on a core of the reel, and/or the pack, are used to identify the packaging material and to check it for correct assignment in relation to the type of pack which is to be produced.

Accordingly, the invention automatically ensures that after a change the correct packaging material is used and the correct pack contents are packed. The markings on the packaging material or on the cigarettes may be formed specifically for identification with the aid of optoelectronic monitoring elements. Alternatively, it may be the standard design of the pack or of the cigarettes which is concerned, it being the case that, for the respective type of pack, characteristic external features, for example the brand mark, are used for identification.

The apparatus according to the invention is provided at suitable locations, namely in the region of conveying paths for packaging material, on the one hand, and in the region of conveying paths for cigarettes or cigarette groups, on the other hand, with optoelectronic sensing elements which sense, for example, from above the articles moved past them and which record characteristic features or markings for identification. The signals received are fed to an evaluation unit and, in the region of the latter, compared with stored, correct features. When incorrect packaging material or incorrect contents are detected, an appropriate signal is generated.

All recognition data for each type of pack and cigarette are stored in the control system and are compared continually or whenever necessary (change of brand) with the materials being run on the machine. The control system does not issue an enabling signal until all data are completely consistent. These recognition data vary according to the type of pack and cigarette and can be switched by the operator at the touch of a button or transmitted from a central control system to the control system of the respective packaging machine.

The packaging material, for example a material web wound to form a reel, can in the simplest case be identified by the application of, for instance, a dot-like marking of a different geometric form and/or color. The markings can also be applied with the help of labels.

BRIEF DESCRIPTION OF THE DRAWINGS

Further details of the invention are explained in more detail below with reference to exemplary embodiments illustrated in the drawings, in which.

DETAILED DESCRIPTION OF THE INVENTION

Figure 1:
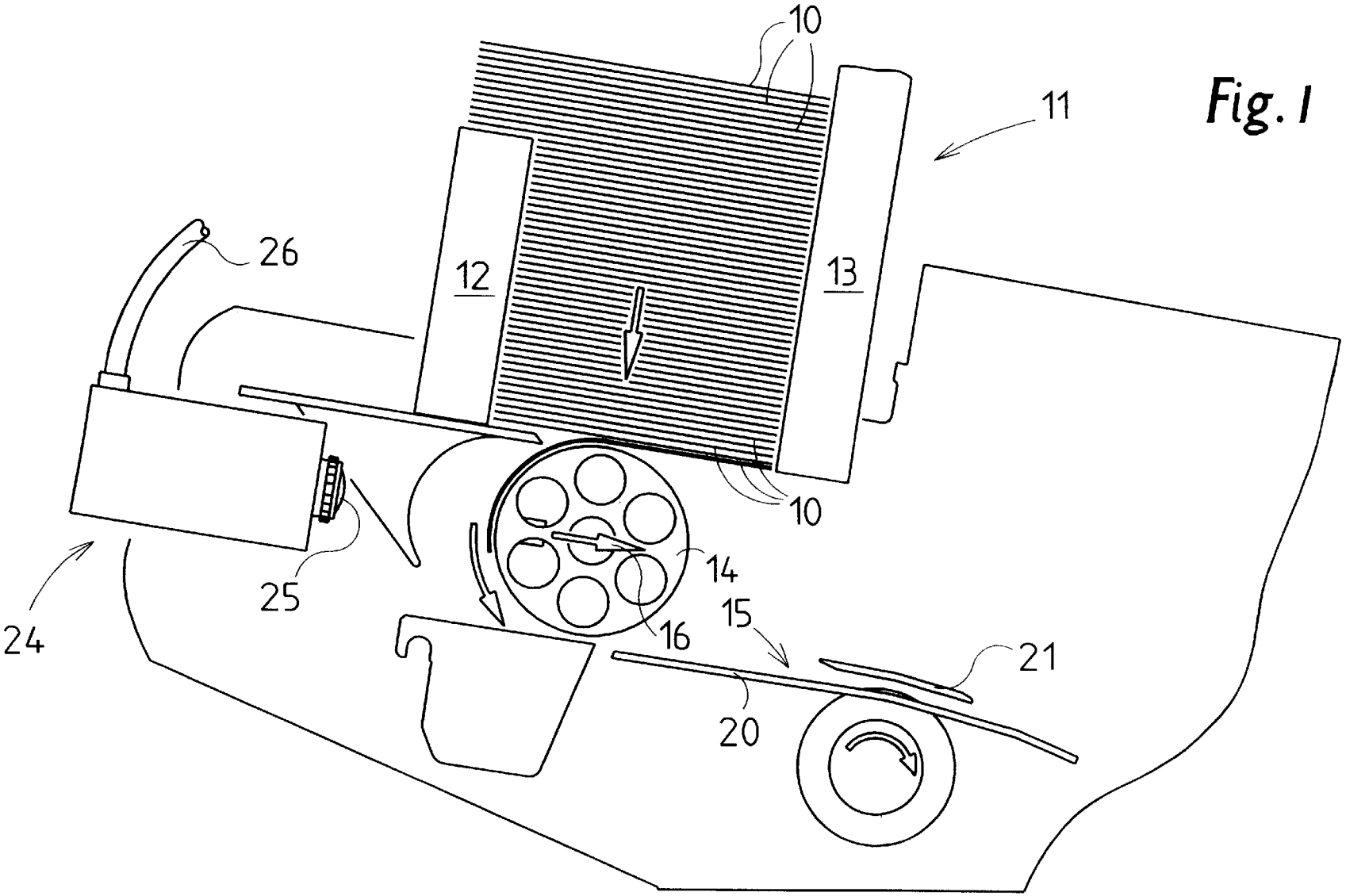
FIG. 1 shows a side view of part of a packaging machine with a blank magazine and CCD camera.

FIG. 1 shows part of a packaging machine for producing cigarette packs. This part is involved in the removing and feeding of blanks 10 from a blank magazine 11. Said blank magazine 11 has two side walls 12, 13, which guide the blanks and prevent said blanks 10 from sliding away laterally.

A removal element designed as a transfer roller 14 removes in each case one blank 10 from the bottom of the blank magazine 11. The blank is held on a peripheral surface of the circular transfer roller 14 by suction bores (not shown) so that the blank lies on the peripheral surface of the transfer roller 14 as the latter is moved in the direction of arrow 16. The removed blank 10 is transferred to a blank path 15.

The blank 10 is positioned on the removal element, namely on the transfer roller 14, in such a way that a side of the blank provided with markings is assigned to a scanning element, namely in the present case to a CCD camera 24. This is positioned so that a lens 25 of the CCD camera 24 is aimed at the arched blank 10. The blank 10 is usually positioned on the transfer roller 14 in such a way that the printed, i.e. outer, side of the blank is on the outside, i.e. facing the CCD camera.

The apparatus can be so arranged that only the first blank 10 taken from the blanks magazine 11 is sensed or scanned by the CCD camera 24. But the apparatus can also be operated in that every blank 10 is checked by the camera 24. In this case, in particular characteristic features of the blank 10 suitable for identifying the material are scanned. As an alternative, the blank 10 can be provided with markings which are applied for the explicit and exclusive purpose of identifying the material and which are scanned by the camera 24.

The camera 24 is linked by means of a cable 26 to the central evaluation unit, in which the scanned markings are evaluated or a recorded image is compared to a stored, correct calibration image.

Figure 2:
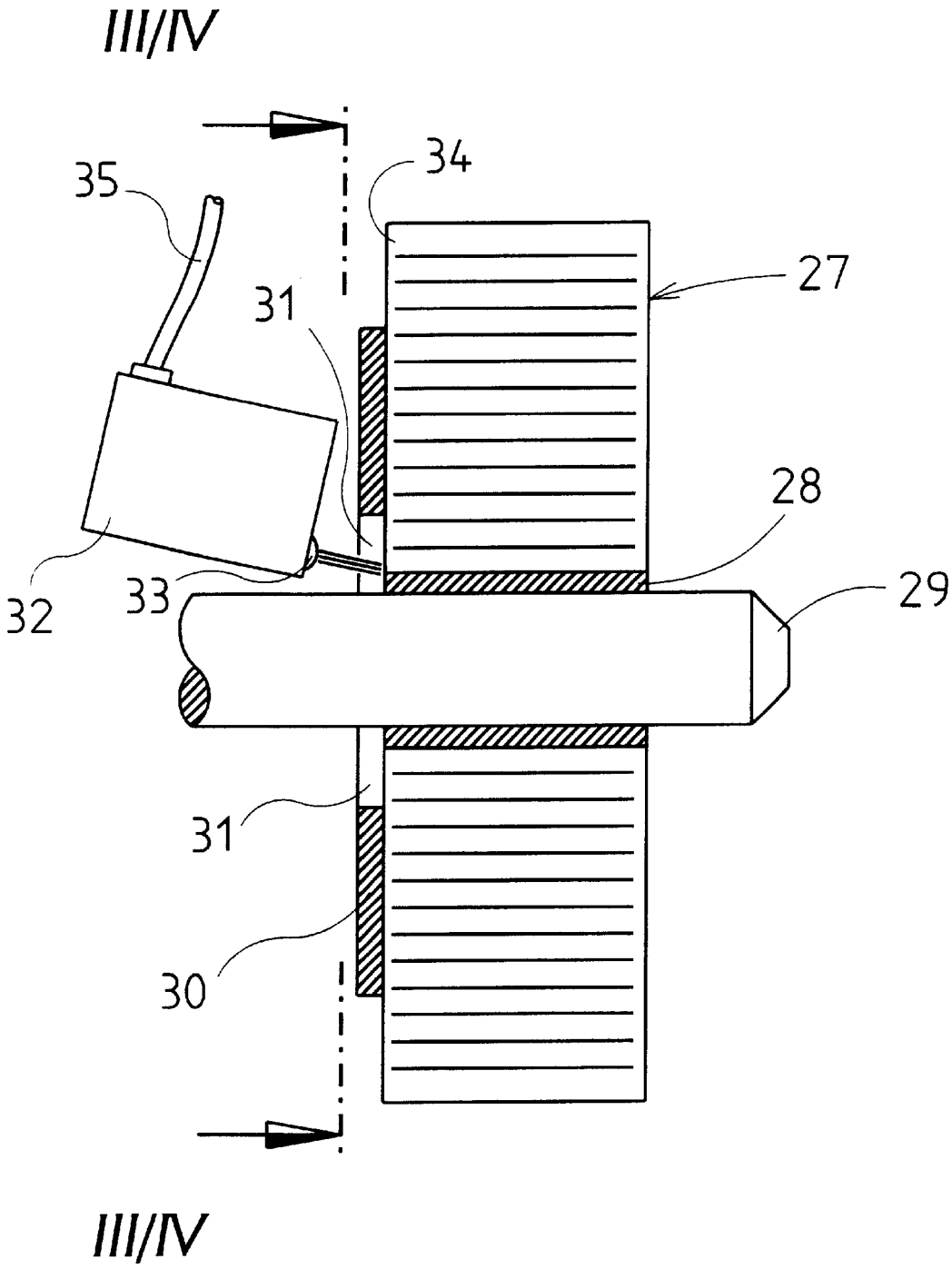
FIG. 2 shows a cross-sectional view of a reel with packaging material and a laser scanner.
Figure 3:
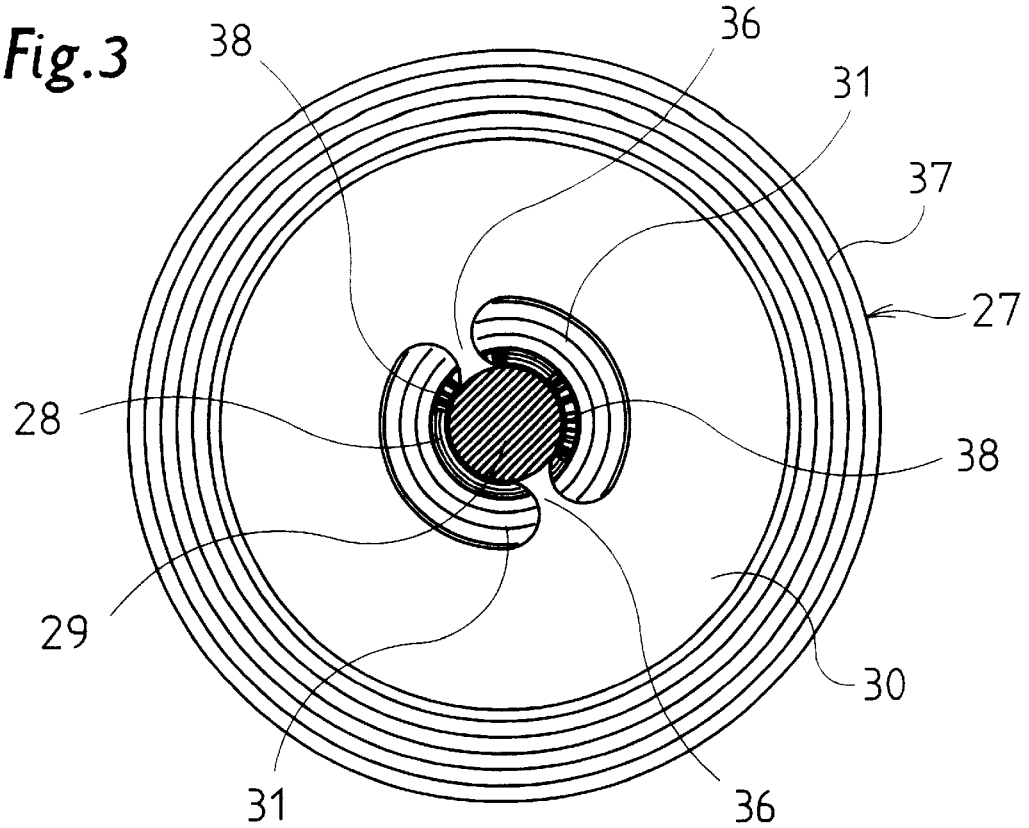
FIG. 3 shows an arrangement according to FIG. 2 in a section taken along section line III/IV—III/IV.
Figure 4:
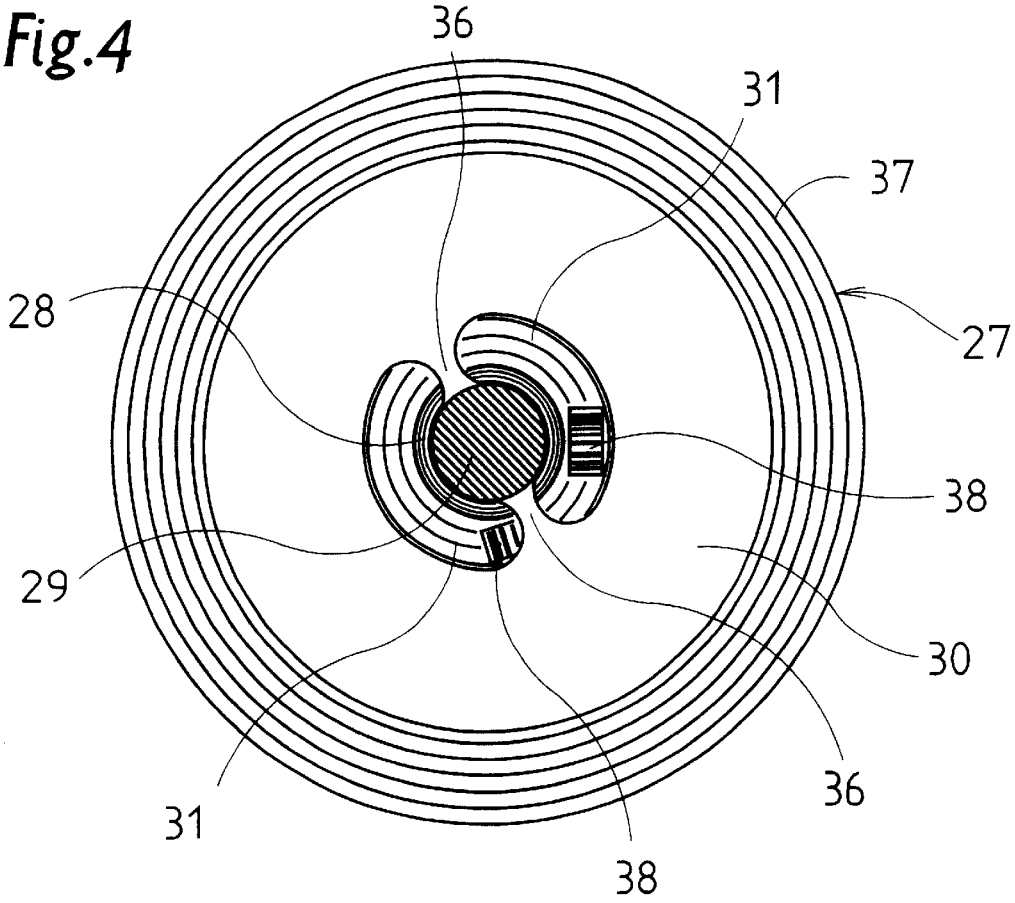
FIG. 4 shows a further arrangement according to FIG. 2 in a section taken along section line III/IV—III/IV.

FIG. 2, FIG. 3 and FIG. 4 present examples for checking wound (packaging) material, i.e. reels. These can serve to manufacture an inner wrapping of the pack contents (inner liner) in the packaging of cigarettes or as an outer wrapping. In the first case, the material web comprise tin foil or paper, if necessary also a plastic film. Regenerated cellulose film or plastic film is generally used for the outer wrapping.

FIG. 2 shows a cross section through a corresponding reel 27. In the case of this reel 27, the packaging material is wound around a reel core 28. Said reel core 28 is seated on a stub 29, which bears the reel 27.

The reel 27 is pushed onto the stub 29 to such an extent that it comes into contact with a stop disc 30. The stop disc 30 has openings 31. Through these openings 31, an optoelectronic scanning means, designed for example as a laser scanner 32, can view the end surface 34 of the reel. For this purpose, a laser-light-emitting component, for example a laser diode 33, is arranged on the laser scanner 32 such that the laser beam emitted can make contact, through the opening, with the end surface 34 of the reel. The laser scanner 32 picks up again the laser light reflected by the end surface 34 of the reel and converts it into a corresponding signal. A cable 35 passes on this signal from the laser scanner 32 to the evaluation unit (not illustrated). Finally, by way of the signal produced by the laser scanner 32, the evaluation unit identifies the packaging material wound up on the reel 27.

Furthermore, the evaluation unit checks whether the identified packaging material corresponds with the expected packaging material. In this way, the evaluation unit can establish whether the packaging machine has been charged with the correct packaging material. If the evaluation unit establishes an error, it gives out a corresponding error signal. Alternatively or additionally, it interrupts the production process, that is to say it brings the packaging machine to a standstill.

FIGS. 3 and 4 each show a reel 27 with a stop disc 30 in a section taken along section line III/IV—III/IV (FIG. 2). These stop discs 30 each have two openings 31. These openings 31 are of such a magnitude that in each case just two spokes or connecting webs 36 are left. In addition, the openings 31 are of disc-shaped contour. Through the openings 31, it is possible to see the layers, in each case of a material web 37 of packaging material, which are wound up onto the reel core 28. The reel core 28 is seated—as in FIG. 2—on the stub 29.

FIG. 3 shows a bar code 38 provided on the reel core. In contrast to FIG. 3, in FIG. 4 the bar code 38 is provided on the layers of the material web 37 rather than on the reel core 28. When the material web 37 is being unrolled from a reel 27, the reel 27 rotates about the stub. In this case, the bar code 38, which is provided on the reel 27, also rotates. A laser scanner 32, which is provided in front of the openings 31, can then scan the rotating bar code 38 in order to produce a scanning signal for identifying the packaging material used.

The arrangement of a laser scanner 32 installed in a stationary manner and of the bar code 38 rotating away beneath the same allows the laser scanner to read the entire bar code 38 without difficulty.

The stop disc 30 preferably rotates with the reel 27. This has the advantage that there is no friction between the stop disc 30 and packaging material wound up on the reel 27. In this case, at least two bar codes are applied to the reel 27, namely either on the reel core 28 and/or on the packaging material wound up on the reel 27. This is because it is possible for at least one bar code 38 to be concealed at least partially behind a connecting web 36. In this case, correct scanning of the bar code 38 would no longer be ensured. As a result, a number of the same bar codes 38 have to be provided. A second bar code 38 thus has to be spaced apart from a first bar code 38 by a distance which corresponds at least to the width of the connecting web 36. Moreover, the longitudinal extent of the bar code 38 is not any larger than the opening 31. As a result, at least two bar codes 38 are arranged such that at least one can be seen in its entirety in an opening 31, even if the second bar code 38 is concealed by a connecting web 36.

In the case of an alternative configuration, it is merely the reel 27 which rotates, while the stop disc 30 is at a standstill. In this case, one bar code per reel is sufficient. However, the laser scanner 32 has to be arranged such that it views the (stationary) opening 31. In the case of this variant, it is nevertheless necessary to ensure that excessive friction does not occur between the stop disc 30 and packaging material or the lateral edges of the material web 37, in order to avoid damage to the packaging material.

The bar code 38 applied to the material web 37 is preferably applied directly onto the layers of the material web 37 by means of an ink-jet printer. Accordingly, it is also possible for the bar code 38 to be applied to the reel core 28 by means of ink-jet printing. However, the practice of applying adhesive labels with bar codes 38 is also suitable specifically for the reel core 28.

Figure 5:
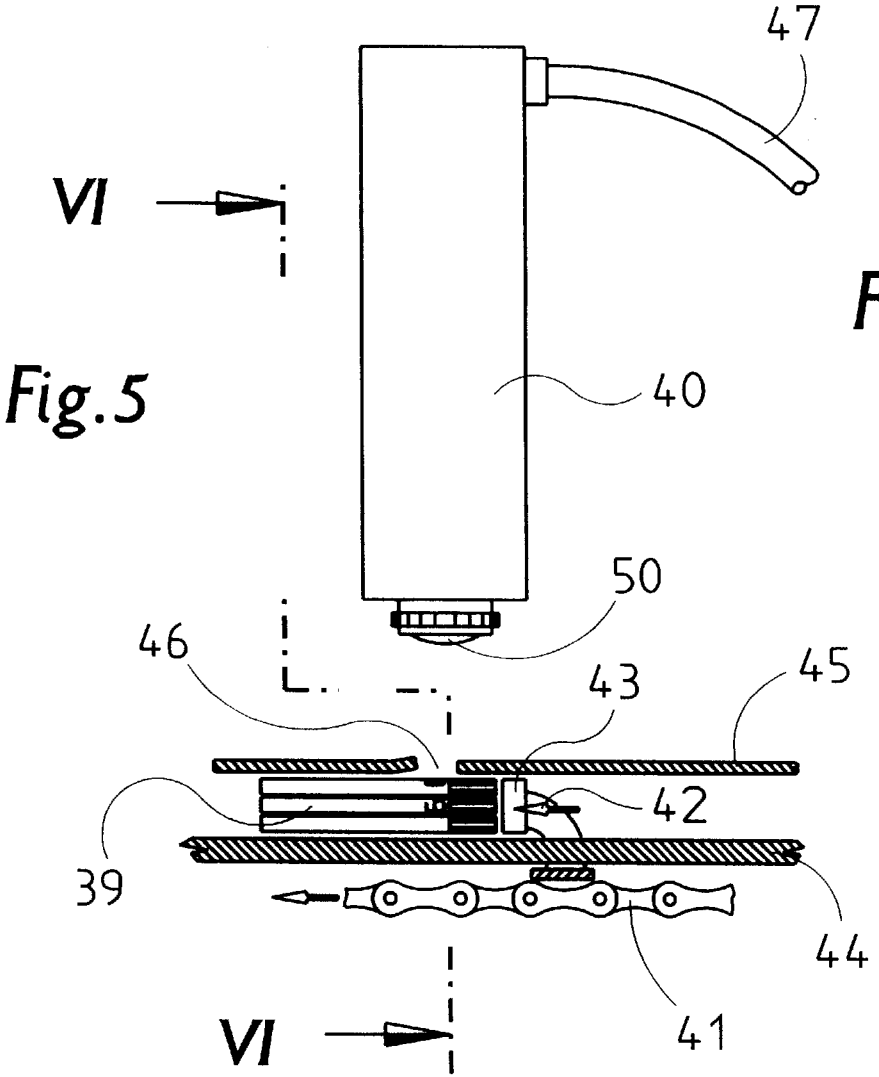
FIG. 5 shows a further part of a packaging machine with cigarette block and CCD camera.

FIG. 5 shows a cigarette block 39 with three layers of cigarettes. As the production process continues, said cigarette block 39 is introduced into a pack formed by the packaging machine. In order to ensure that cigarette blocks 39 which are to be introduced belong to the type of pack which is to be produced, the cigarette block 39 is checked as well. A further optoelectronic sensing element, namely a further CCD camera 40, is provided for this purpose. Said CCD camera 40 senses markings on the cigarette itself, for example the printed-on cigarette brand, rings on the filter or in the vicinity of a cigarette end or other text or printing on the cigarettes. In this case, the CCD camera is arranged such that it can sense an entire layer of a cigarette block 39.

In the production process, a carry-along element 43 which is driven by a chain conveyor 41 conveys a cigarette block 39 in the direction of the arrow 42. The cigarette block 39 is guided by a bottom guide 44 beneath the cigarette block 39 and by a top guide 45 above the cigarette block 39. The top guide 45 is interrupted in the region of the CCD camera 40 and has an opening 46 there. Through this opening 46, the CCD camera 40 can view the cigarette block 39, namely the top layer thereof. As a cigarette block 39 is pushed through the bottom guide 44 and the top guide 45, the CCD camera 40 can sense the markings provided on the top layer of the cigarette block 39 and convert them into a corresponding signal. This signal is routed to the evaluation unit via a connection, for example a cable 47. The evaluation unit assigns the sensed signal to a certain type of cigarette and in this way can identify the cigarettes or the type of cigarette. The evaluation unit also checks whether the identified type of cigarette corresponds to the type of pack which is to be produced, that is to say whether the assignment of the cigarette in relation to the type of pack which is to be produced is correct.

Figure 6:
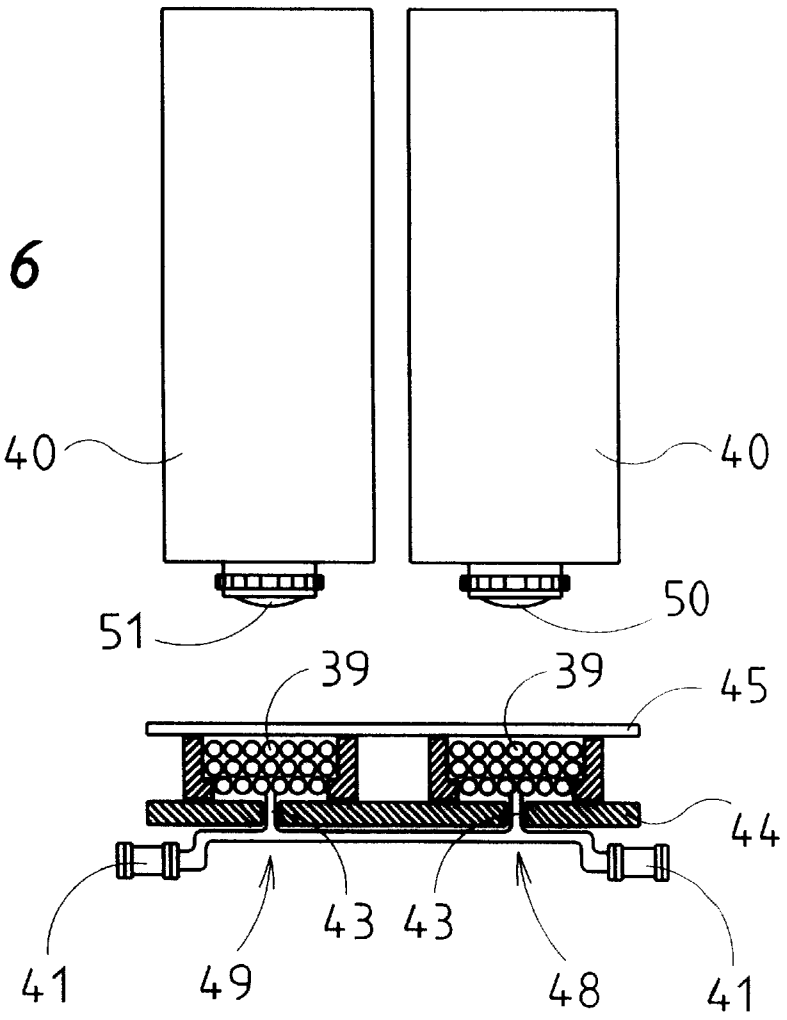
FIG. 6 shows an arrangement according to FIG. 5 in a section taken along section line VI—VI.

FIG. 6 shows the arrangement from FIG. 5 in a section taken along section line VI—VI. Since in each case two cigarette blocks 39 are processed here at the same time, two carry-along elements are provided, or a double-size carrying-along element 43, which is driven by two chain conveyors 41, is provided. It is also possible to see two openings 48, 49 in the bottom guide 44, through which the carry-along element 43 projects. In this case, the top guide is of such a width that it covers over the two cigarette blocks 39 completely. However, the top guide 44, just as in FIG. 5, has an opening 46, so that FIG. 6 shows that edge of the top guide 45 which is formed by the opening 46. Through the opening 46, the lenses 50, 51 of the CCD camera 40 can view the cigarette blocks 39 guided through beneath them.

Additionally or alternatively, it is also possible for the opening to be provided in the bottom guide. In this case, the CCD cameras are provided beneath the bottom guide, the lenses being oriented upward. However, it is also possible for one or more CCD cameras to be arranged alongside the top and bottom guides.

The signals produced by the optoelectronic sensing elements or scanning means, namely the CCD camera 24, 40 or the laser scanner 32, are fed—as explained—to the evaluation unit. The evaluation unit uses these signals to identify the packaging materials or the pack contents, namely cigarettes, and checks whether the packaging materials used and/or the cigarettes correspond to the type of pack which is to be produced. Identification takes place, for example, by a signal comparison with reference signals.

In addition to, or instead of, such a comparison of a received signal with a stored signal, it is also possible for the received signal to be fed to a filter, for example a so-called matched filter, which is matched to the expected signal. Then, by way of the starting signal of the matched filter, a threshold decision element provides the decision as to whether the received signal corresponds to the expected signal and thus to the expected packaging material or contents.

However, it is also possible to use other signal-processing methods for identifying the packaging material or the type of cigarette.

The operation of identifying and checking packaging material and cigarettes takes place, in particular, when a packaging machine has run empty and has been newly started up. At the beginning of a new production cycle, at least the first cigarette blocks and packaging units, for example blanks, are checked. Preferably the first five cigarette blocks, or five pairs of cigarette blocks, and the first five, or five pairs of blocks, and the corresponding packs, with the result that, after this number, the sensing elements, namely CCO cameras and laser scanner, and the evaluation unit can be switched off. In the case of one variant, however, the system formed in this way continues throughout the entire production process.

The process according to the invention and the corresponding apparatus ensure that incorrect material is detected straight away. This makes it possible to avoid errors caused by human error, that is to say loading the packaging machine with incorrect packaging material or incorrect cigarettes. It is thus also possible, without difficulty, for a packaging machine which uses the process according to the invention, and an apparatus according to the invention, to be operated by operators who have been acquainted with it for only a short period of time and/or without lengthy training procedures being required.

What is claimed is:

1. An apparatus for producing cigarette packs using blanks which are produced by being severed from a material web (37) wound as a reel (27), a) wherein the reel (27) is provided with an optoelectronically detectable marking, and said apparatus comprises:

b) a stub (29) on which the reel (27) is mounted for drawing off the material web (37); and c) an optoelectronic sensing element (37), assigned to the reel, for sensing the marking on the reel while the reel (27) is mounted on the stub (29), and wherein the marking is a code (38) on a lateral end surface of the reel (34), and wherein the optoelectronic sensing element is a laser scanner (32) located laterally next to the reel (27,) in a stationary manner in such a way that a laser diode (33) of said scanner is directed at the code (38).

2. The apparatus according to claim 1, wherein said code is a bar code.

3. The apparatus according to claim 2, wherein:

a) the reel (27), mounted on the stub (29), lies with a reel end surface (34) abutting a stationary stop disc (30) of the stub;

b) the stop disc (30) has an opening (31) in a region of the bar code (38); and c) the laser scanner (32) is positioned such that said laser diode is directed at the opening (31).

4. The apparatus according to claim 3, wherein the stop disc (30) has two circular openings (31) adjacent to the stub (29).

5. An apparatus for producing cigarette packs using blanks which are produced by being severed from a material web (37) wound as a reel (27), a) wherein the reel (27) is provided with an optoelectronically detectable marking, and said apparatus comprises:

b) a stub (29) on which the reel (27) is mounted for drawing off the material web (37); and c) an optoelectronic sensing element (37), assigned to the reel, for sensing the marking on the reel while the reel (27) is mounted on the stub (29), and wherein:

d) the reel (27) is wound on an inner, cylindrical reel core (28) through which the stuib (29) is inserted; and e) an annular end face of the reel core (28) is provided with the marking (38).

* * * * *